US005557959A

United States Patent [19]

Wallis et al.

[11] Patent Number: 5,557,959

[45] Date of Patent: Sep. 24, 1996

[54] MODULAR DIE TRANSFER SYSTEM

[75] Inventors: Bernard J. Wallis, Dearborn; Sabatino A. Bianchi, Bloomfield Hills, both of Mich.

[73] Assignee: Livernois Research & Development Company, Dearborn, Mich.

[21] Appl. No.: 280,089

[22] Filed: Jul. 25, 1994

[51] Int. Cl.[6] ..... B21D 43/05

[52] U.S. Cl. ..... 72/20.2; 72/405.13; 72/405.16

[58] Field of Search ..... 72/405, 405.11, 72/405.16, 405.13, 20.5, 20.2; 198/621.1–621.4; 74/104

[56] References Cited

U.S. PATENT DOCUMENTS

| | | | |
|---|---|---|---|
| 3,988,937 | 11/1976 | Higuchi | 198/621.1 |
| 4,032,018 | 6/1977 | Wallis | 198/750 |
| 4,809,533 | 3/1989 | Owens | 72/405 |
| 4,833,908 | 5/1989 | Sofy | 198/621.1 |
| 5,307,666 | 5/1994 | Bianchi | 72/405 |

FOREIGN PATENT DOCUMENTS

| | | | |
|---|---|---|---|
| 2632593 | 2/1977 | Germany | 72/405 |
| 185164 | 7/1993 | Japan | 72/405 |

OTHER PUBLICATIONS

Wallis, "Transfer Die Technology," Livernois Automation Company (1991).

"Rotary Cam Series Transfer Systems," Livernois Automation Company, Brochure LAC–2003 (Feb. 1990).

*Primary Examiner*—Daniel C. Crane

*Attorney, Agent, or Firm*—Barnes, Kisselle, Raisch, Choate, Whittemore & Hulbert, P.C.

[57] ABSTRACT

A die transfer system for transferring workpieces through successive die stations in a stamping press includes an enlongated finger bar having spaced fingers for engaging workpices at successive die stations, a first drive mechanism for reociprocating the finger bar longitudinally for transferring workpieces between successive die stations, and a second drive mechanism for reciprocating the finger bar laterally into and out of engagment with the workpieces at the die stations. The second drive mechanism has at least two finger bar drive modules coupled to the finger bar and spaced from each other lengthwise of the finger bar. A drive shaft extends between and interconnects the two drive modules. Each of the drive modules has a crank arm coupled to the drive shaft for rotating the crank arm about an axis parallel the finger bar. A cam plate is coupled to the finger bar and mounted for movement lateral to the crank arm axis and the finger bar. The cam plate has a cam slot extending in a direction lateral to the crank arm axis, and a cam follower is mounted on the crank arm and disposed in the slot such that rotation of the drive shaft rotates the crank arm and propels the cam follower along the cam plate slot while simultaneously driving the cam plate and the finger bar laterally into and out of engagement with workpieces at the die stations. The drive shaft is rotated in synchronism with operation of the stamping press by an electric servo motor and motor controller coupled to a sensor for monitoring position of the stamping press ram.

29 Claims, 8 Drawing Sheets

MODULAR DIE TRANSFER SYSTEM

The present invention is directed to die transfer systems, and more particularly to a modular arrangement for indexing workpieces through successive die stations in a stamping press.

BACKGROUND AND SUMMARY OF THE INVENTION

In die transfer systems of the subject character, a finger bar extends along one or both lateral sides of the die stations of a stamping press, and fingers extend inwardly from the finger bar or bars for engaging workpieces at the successive die stations. The finger bar or bars are driven longitudinally and laterally in synchronism with operation of the press for transferring workpieces through successive die stations and then out of the die. U.S. Pat. Nos. 4,032,018 and 5,307,666 each disclose die transfer systems of this general character, in which the finger bars are mechanically coupled by cam-and-follower arrangements to the ram of the stamping press for controlling operation of the finger bars.

It is a general object of the present invention to provide a die transfer system of the general type disclosed in the above-noted patents and discussed above, in which the transfer system as well as components thereof are of modular construction for providing enhanced flexibility in design and operation, and reduced inventory and maintenance costs. Another and more specific object of the present invention is to provide a die transfer system of the subject character in which the finger bar drive mechanisms are driven by electrically controlled servo motors for providing enhanced design flexibility in synchronizing operation of the transfer system to motion of the press ram.

A die transfer system for transferring workpieces between successive die stations in a stamping press includes an elongated finger bar having spaced fingers for engaging workpieces at successive die stations, a first drive mechanism for reciprocating the finger bar longitudinally for transferring workpieces between successive die stations, and a second drive mechanism for reciprocating the finger bar laterally into and out of engagement with the workpieces at the die stations. In accordance with the presently preferred embodiments of the invention, the second drive mechanism comprises at least two finger bar drive modules coupled to the finger bar and spaced from each other lengthwise of the finger bar. A drive shaft extends between and interconnects the two drive modules. Each of the drive modules includes a crank arm coupled to the drive shaft for rotating the crank arm about an axis parallel to the finger bar. A cam plate is coupled to the finger bar and mounted for movement lateral to the crank arm axis and the finger bar. The cam plate has a cam slot extending in a direction lateral to the crank arm axis, and a cam follower is mounted on the crank arm and disposed in the slot such that rotation of the drive shaft rotates the crank arm and propels the cam follower along the cam plate slot while simultaneously driving the cam plate and the finger bar laterally into and out of engagement with workpieces at the die stations. The drive shaft is rotated in synchronism with operation of the stamping press, preferably by an electric servo motor and motor controller coupled to a sensor for monitoring position of the stamping press ram.

The drive shaft in the preferred embodiments of the invention comprise a plurality of shaft segments each extending between and interconnecting an adjacent pair of the drive modules. Each drive module includes facility for interconnecting successive drive shaft segments so that all of the drive shaft segments and all of the finger bar drive modules operate in unison. Stub shafts are carried in each of the drive modules, and are interconnected by gears on the respective shafts. One of the stub shafts is connected to the crank arm of the associated module. The drive shaft segments that interconnect each module with the adjacent modules are connected by couplers to opposite ends of one of the stub shafts, or are connected to the ends of the respective stub shafts so that the two drive shaft segments are laterally offset from each other. Each of the finger bar drive modules preferably comprises a fixed support having a pocket in which the gears are disposed, and a cover plate enclosing the pocket. The cam plate is mounted on the support by a linear bearing arrangement for stabilizing operation of the cam plate.

In one embodiment of the invention, the cam plate has a single cam slot for providing lateral motion of the finger bar in only one direction and essentially shuttling workpieces in a plane from station to station in the stamping press. In another embodiment of the invention, the cam plate has first and second orthogonal interconnected cam slots, so that rotation of the drive shaft and crank arm propels the cam follower along the first and second slots in sequence, and thereby drives the cam plate and the finger bar sequentially in first and second directions at right angles to the crank arm axis and to each other. This embodiment thus implements three-direction motion of the finger bar to move the workpieces longitudinally between successive die stations, lower the workpieces onto the die stations, retract the finger bar and fingers laterally outwardly and rearwardly, and then propel the finger bars and fingers inwardly and then upwardly to lift the workpieces for a subsequent transfer operation. In such two-axis drive modules, a locking cam is operatively coupled to the drive shaft for corotation with the crank arm, and a locking cam follower is coupled to the cam plate. The locking cam has an arcuate surface that engages the locking cam follower during motion of the crank arm follower along the second cam plate slot to prevent the cam plate and the finger bar from reverse motion in the first direction during motion thereof in the second direction.

As noted above, the drive shaft that interconnects the finger bar drive modules preferably is coupled to an electric servo motor for operating the finger bar responsive to position of the stamping press ram. A sensor provides an electrical signal as a function of press ram position, and a motor controller has information prestored in memory coordinating desired finger bar position with sensed press position. This information is retrieved as a function of the press position signal, and the servo motor is operated accordingly to control position of the finger bar. This arrangement has the advantage of providing enhanced design and operating flexibility. For example, motion of the finger bar can be readily limited to less than full available motion of the crank arm and cam plate by simply reconfiguring the data prestored in the motor controller memory. In the same way, acceleration and velocity of the finger bar, and of workpieces engaged and carried by the finger bar, may be readily controlled and varied by reconfiguring the control information stored in the motor controller.

In the preferred embodiments of the invention, the finger bar is indexed longitudinally of the die stations by an electric servo motor coupled by an endless belt arrangement to the finger bars to reciprocate the finger bars back and forth with respect to the die stations. The indexing motor is controlled as a function of press ram position, providing the same enhanced design and operating flexibility discussed immediately above. The finger bar and drive arrangement may be employed singly or in pairs disposed on opposite sides of the die stations and mirror images of the other. Each finger bar and associated lateral drive mechanism, as well as the finger bar longitudinal indexing drive mechanism, preferably is mounted on an associated portable base plate as a modular assembly.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
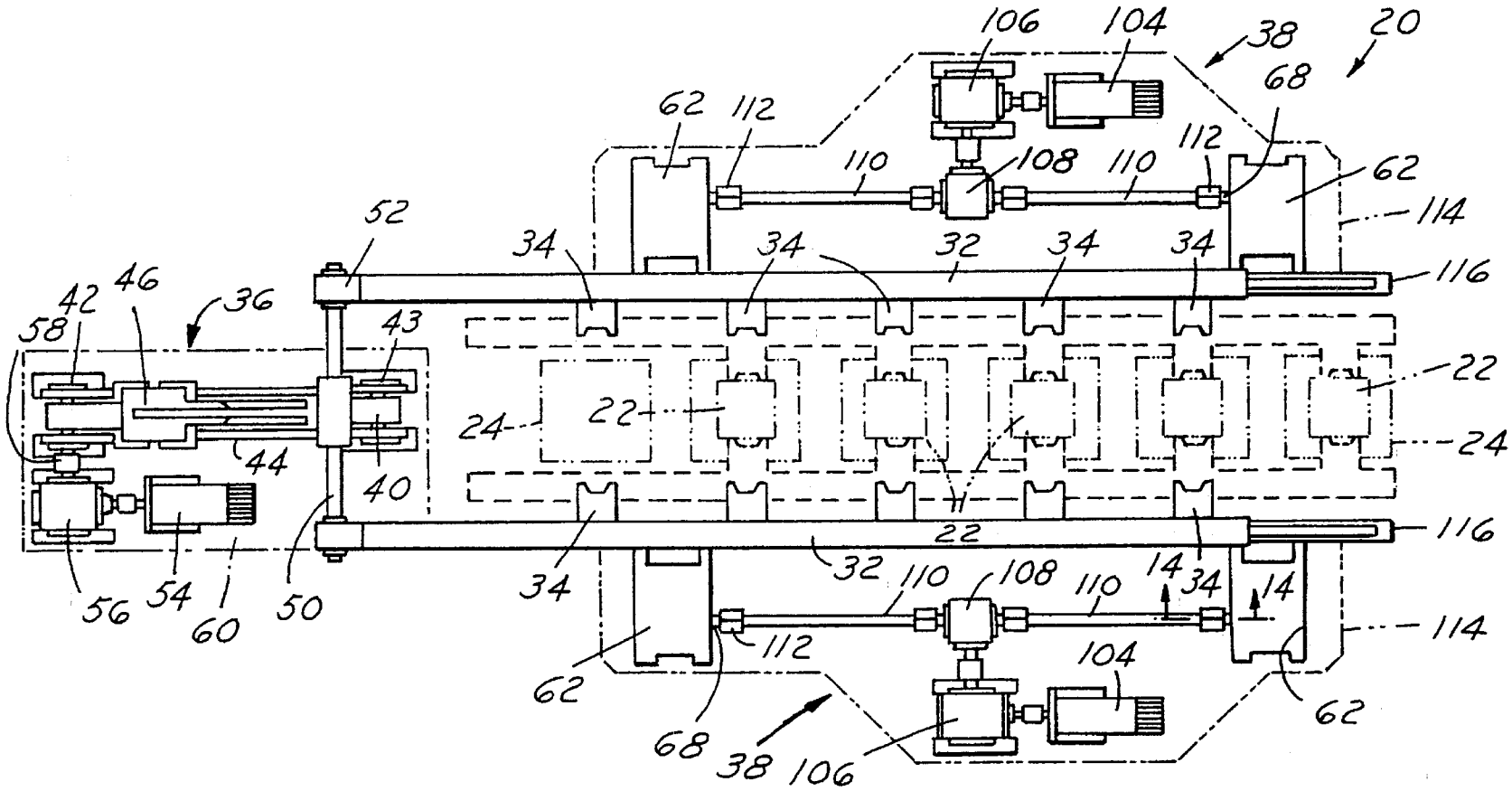
FIG. 1 is a plan view of a die transfer system in accordance with one presently preferred embodiment of the invention.
Figure 2:
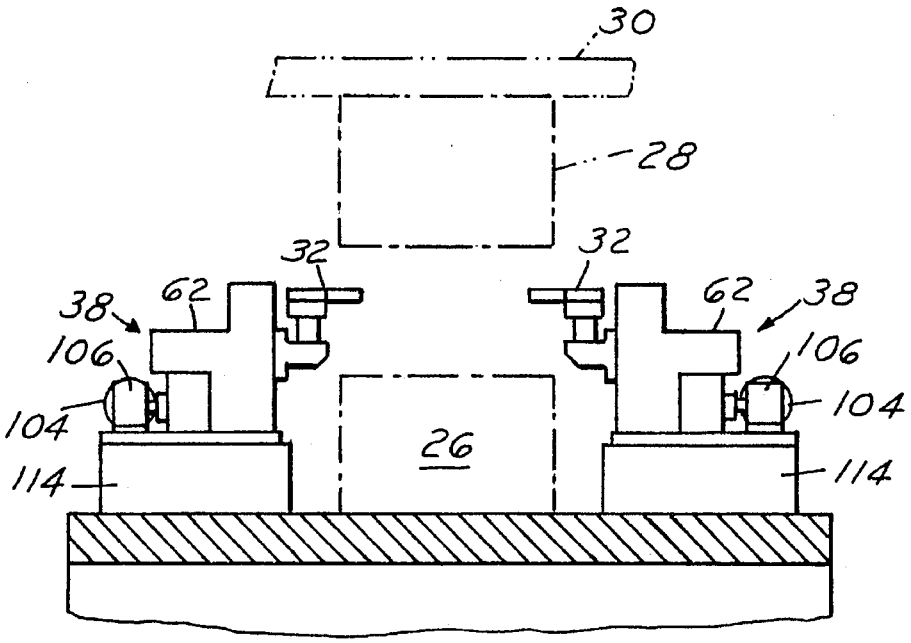
FIG. 2 is an end elevational view of the transfer system illustrated in FIG. 1.

FIGS. 1 and 2 illustrate a die transfer system 20 in accordance with one presently preferred embodiment of the invention for transferring workpieces 22 between successive die stations 24 on the lower die 26 of a stamping press having an upper die 28 coupled to a press ram 30. Transfer system 20 includes a pair of elongated parallel finger bars 32 each having a plurality of spaced fingers 34 for engaging workpieces 22 at successive die stations 24. A longitudinal or indexing drive mechanism 36 is coupled to finger bars 32 for reciprocating the finger bars back and forth in the direction of their length, and thereby transferring workpieces through successive die stations. A pair of laterally opposed drive mechanisms 38 are coupled to finger bars 32 for reciprocating the finger bars laterally into and out of engagement with the workpieces at the die stations. To the extent thus far described, system 20 is of conventional construction and shown, for example, in the above-noted U.S. patents. Lateral drive mechanisms 38 are mirror images of each other, and only one of these systems will be described in detail hereinafter.

Figure 3:
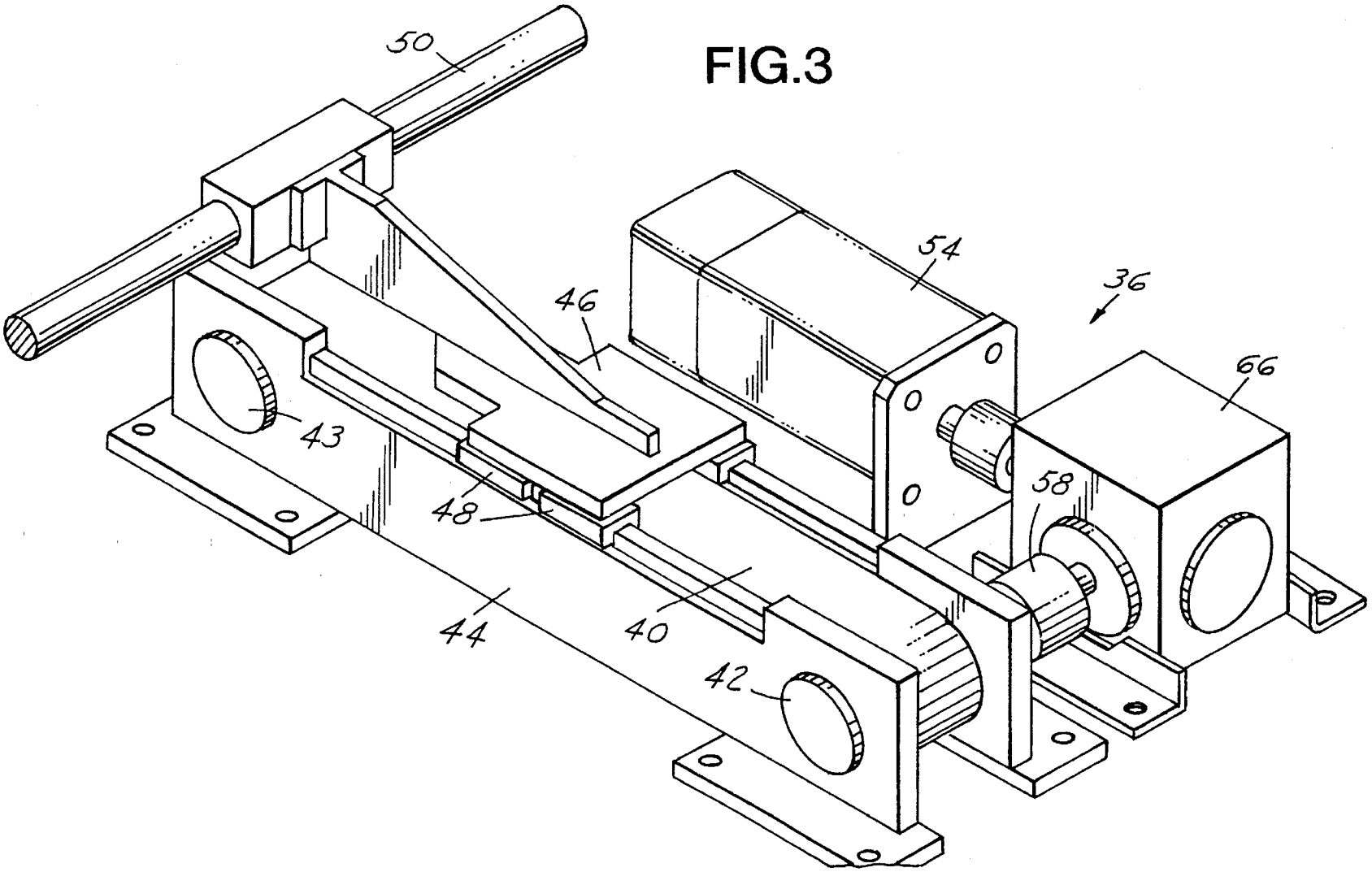
FIG. 3 is a perspective view of the longitudinal drive mechanism in the transfer system of FIG. 1.

Longitudinal drive 36 is illustrated in FIGS. 1 and 3 as comprising an endless belt 40 trained around spaced rotatable pulleys 42,43 mounted on a bracket assembly 44. A slide 46 is mounted on bracket 44 by linear bearings 48, and is coupled to belt 40 for reciprocation in the longitudinal direction of finger bars 32. A rod 50 projects laterally from slide 46, and is coupled to finger bars 32 by a pair of bearings 52 on the opposed ends of rod 50. An electric servo motor 54 is connected by a gear reducer 56 through a coupling 58 to the shaft that drives pulley 42. The entire longitudinal drive mechanism 36 is mounted on a base plate 60 to form a portable modular assembly.

Figure 5:
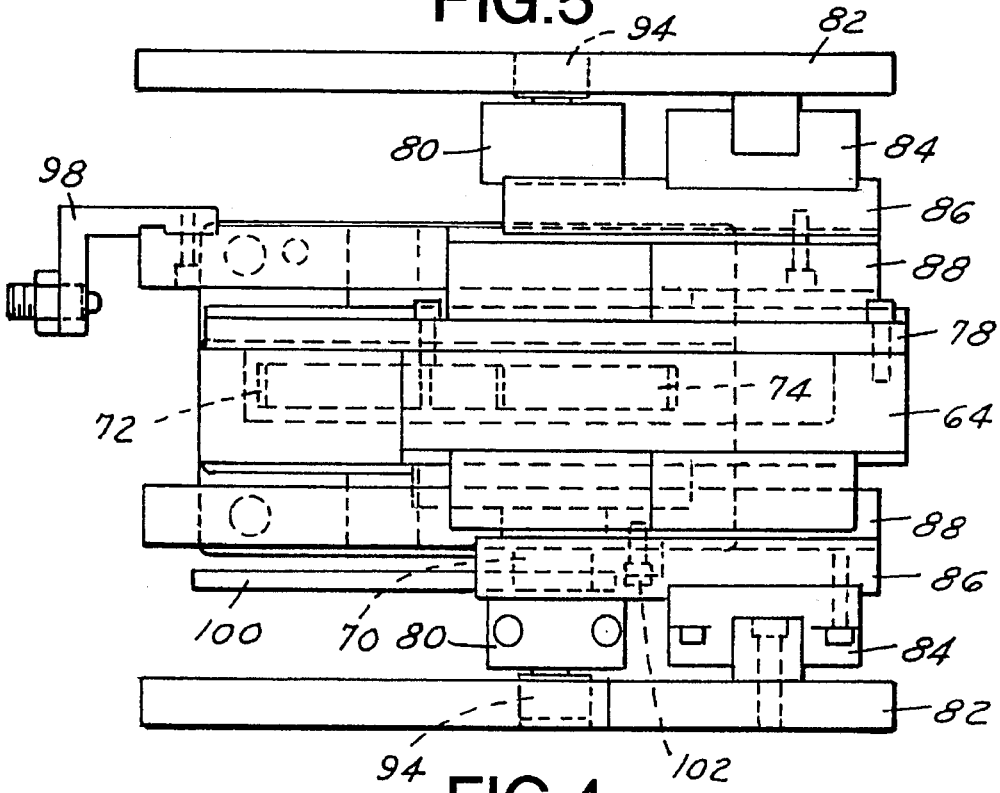
FIG. 5 is a top plan view of the drive module illustrated in FIG. 4.

Each lateral drive mechanism 38 comprises a pair of identical finger bar drive modules 62 spaced from each other lengthwise of finger bar 32. As shown in greater detail in FIGS. 4–6, each finger bar drive module 62 comprises a support stanchion 64 having an internal pocket 66. A pair of stub axles 68,70 are mounted on support 64 by suitable bearings 76. Stub axles 68,70 carry respective intermeshing gears 72,74, which are disposed in assembly within support pocket 66 and enclosed therewithin by a gear cover plate 78. Stub axles 68,70 have ends that project through corresponding openings in support 64 and cover plate 78 for coupling to external structure, as will be described. A crank arm 80 is mounted on each end of axle 70 and coupled to the stub axle for corotation therewith. A cam plate 82 is mounted on opposed sides of support 64 and cover 78 by a vertical linear bearing 84, a bearing connector plate 86 and a horizontal linear bearing 88. Thus, each cam plate 82 is mounted to support 66 for motion horizontally and vertically with respect thereto. Cam plates 82 each have a vertical slot 90 and a horizontal slot 92, which intersect each other at the upper end of slot 90 and the forward end of slot 92. A roller 94 is mounted by a nut 96 at the free end of each crank arm 80, and is disposed within intersecting slots 90,92 of cam plate 82. A stop 98 is mounted on horizontal slide 88 for limiting motion in the forward direction toward lower die 26. A cam 100 is rotatably coupled to one end of stub shaft 70, and has an arcuate outer surface that cooperates with a roller 102 mounted on a bearing connector plate 86 (FIGS. 4 and 5) to prevent outward horizontal motion as the finger bar is raised and lowered, as will be described.

An electric servo motor 104 (FIG. 1) is connected through a gear reducer 106 and a gearbox 108 to a pair of oppositely projecting drivel shaft segments 110. The outer end of each drive shaft segment 110 is connected by a coupler 112 to the inner end of the stub shaft 68 in each of the spaced finger bar drive modules 62. Supports 64 of drive mechanisms 62 are fixedly secured to a base plate 114, as are servo motor 104 and gearboxes 106,108. Thus, each lateral drive mechanism 38 with its associated finger bar 32 forms a portable modular assembly. Each finger bar 32 is mounted to the cam plates 82 and bearing connector plates 86 by a linear bearing assembly 116 (FIGS. 1 and 4) and a bracket 118 affixed by screws 120 to the cam plate mechanisms. Thus, finger bar 32 extends between and bridges finger bar drive modules 62 for coupling to bearings 52 (FIG. 1) as previously described.

Figure 4:
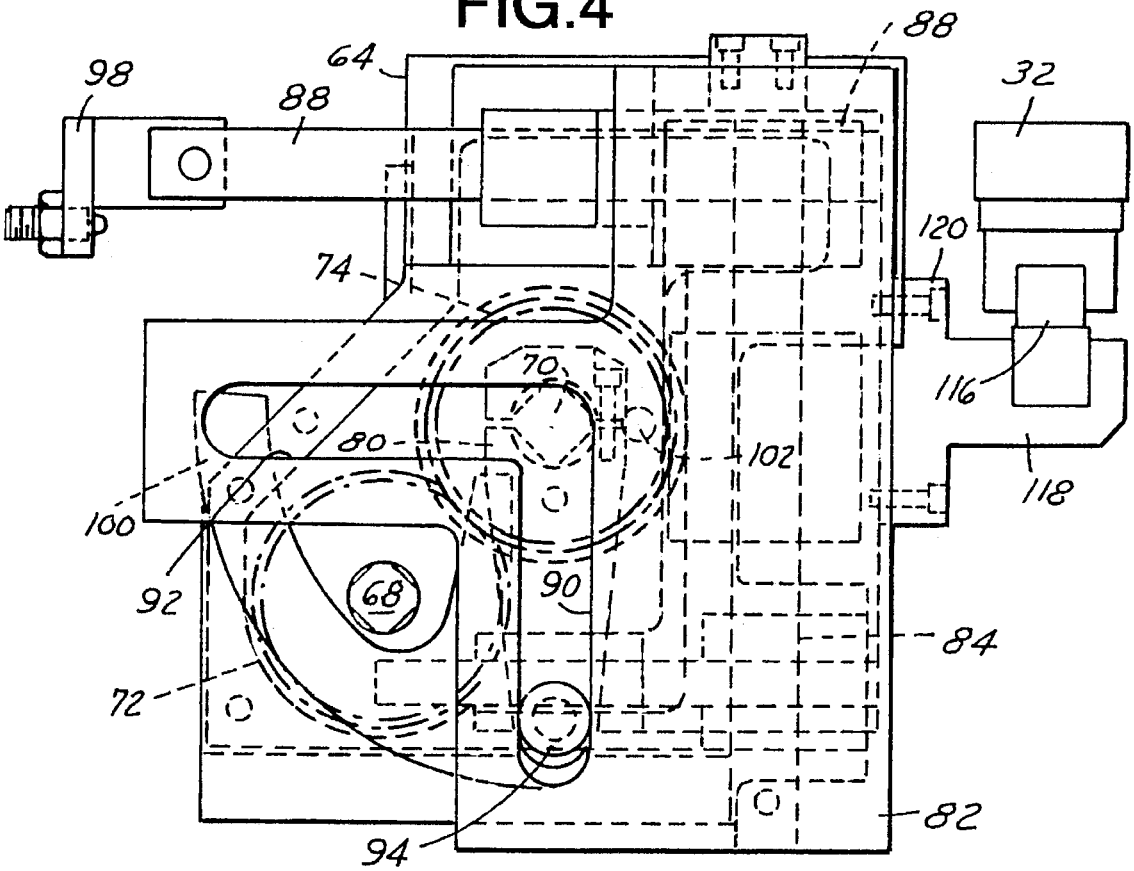
FIG. 4 is an elevational view of a finger bar drive module in the system of FIGS. 1 and 2.
Figure 6:
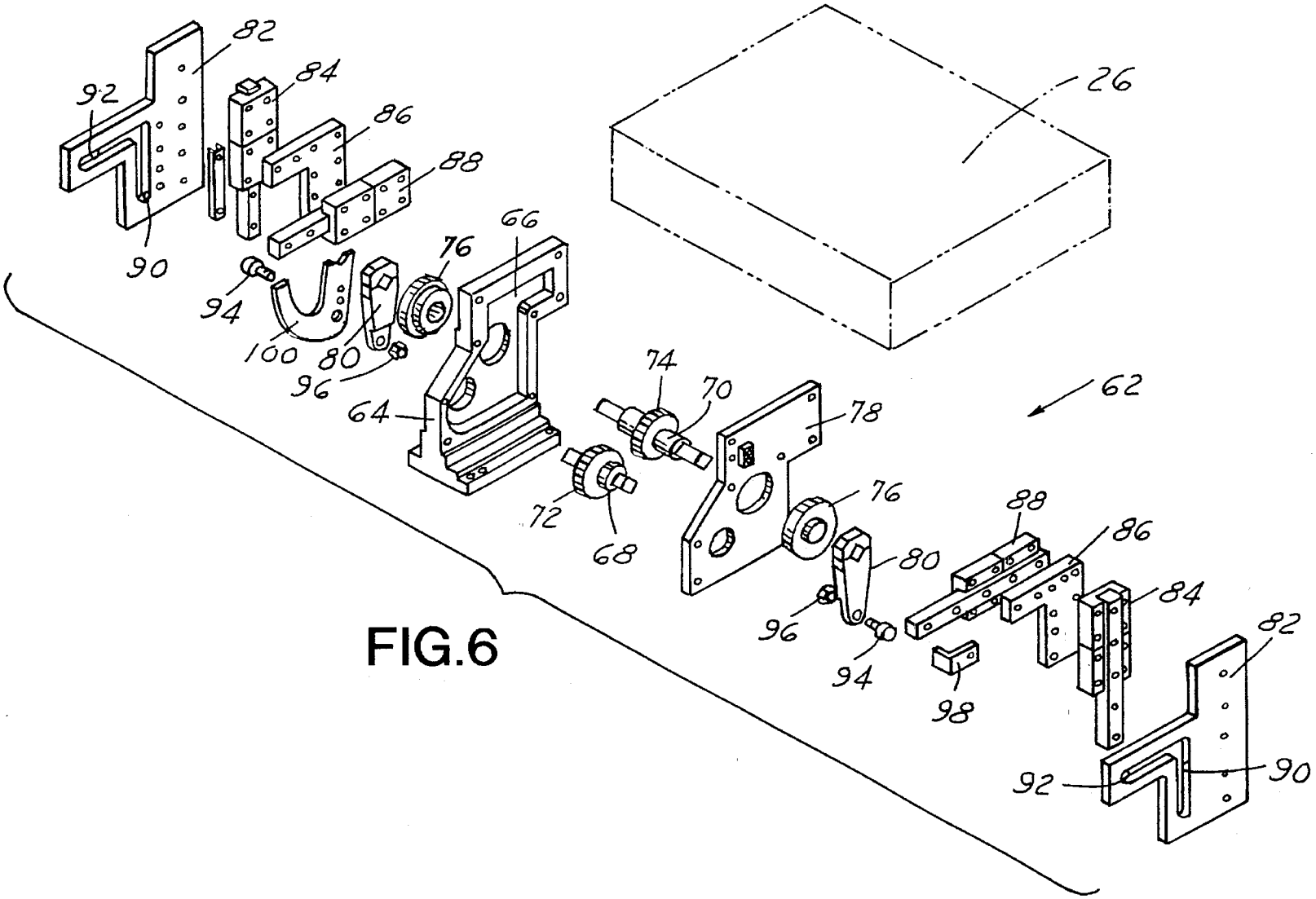
FIG. 6 is an exploded perspective view of the finger bar drive module illustrated in FIGS. 4 and 5.
Figure 8:
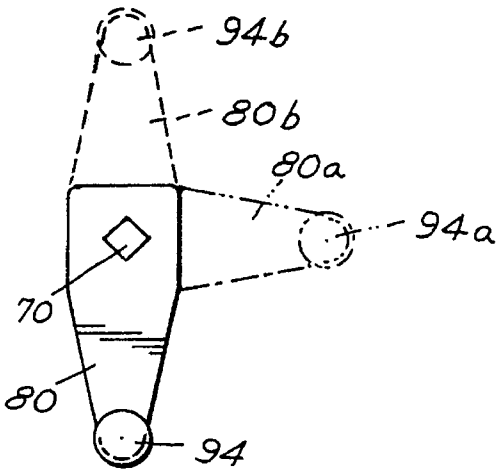
FIG. 8 is a diagrammatic illustration of motion of the crank arm in the finger bar drive module of FIGS. 4–6.

In operation, crank arms 80 of modules 62 are initially disposed in the downward orientation as shown in FIGS. 4, 6 and 8, and cam plates 82 are initially in their fully downward and outward position as shown in FIGS. 4–6 and 9. Cam follower roller 94 is thus disposed at the lower end of cam plate slot 90. As crank arm 80 is rotated 90° counterclockwise as viewed in FIG. 8, follower roller 94 moves upwardly in cam plate slot 90, and propels cam plate 82 inward (with respect to lower die 26) to the position illustrated at 82*a* in FIG. 9. At this point, crank arm 80 and roller 94 are at the positions 80*a*, 94*a* in FIGS. 8 and 9. The finger bars carried by cam plates 82 have at this point been moved horizontally inwardly to their inner most positions for engaging the workpieces on the die stations. At this point, slide stop 98 abuts cover plate 78 to prevent further inward motion of the cam plates and finger bar. Stop cam 100 (FIGS. 4 and 6) will at this point have rotated to a position 90° from that illustrated in FIGS. 4 and 6, so that the arcuate outer surface of cam 100 will begin engaging cam roller 102 on bearing connector plate 86. During continued rotation of shaft 70 and crank arm 80, the arcuate surface of stop cam 100 cooperates with roller 102 to prevent outward motion of cam plates 82 and finger bar 32.

Figure 9:
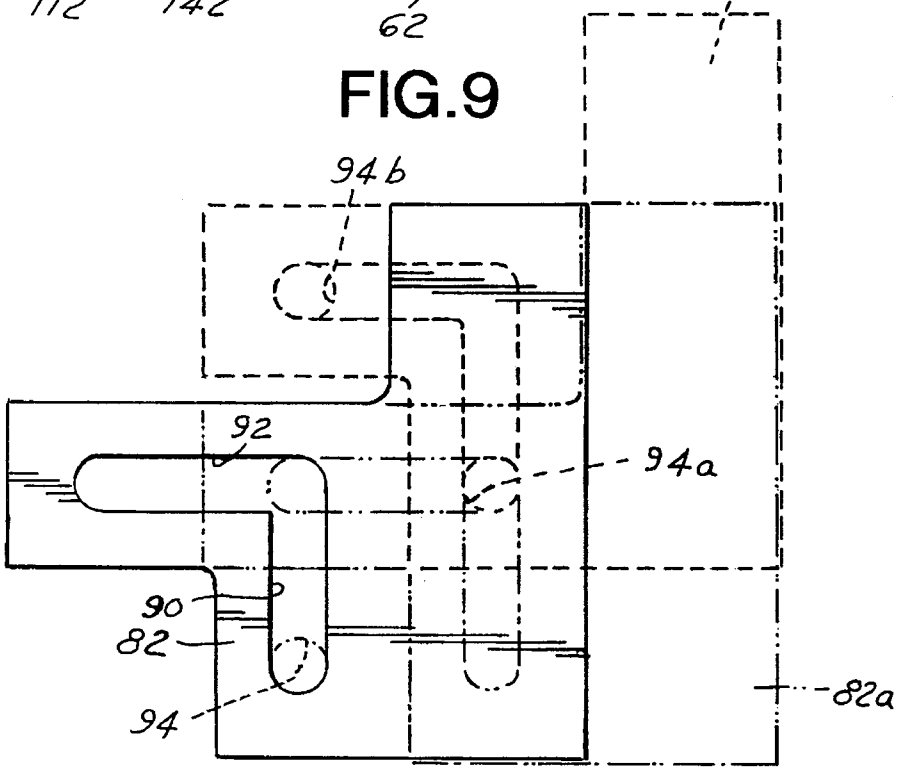
FIG. 9 is a diagrammatic illustration of motion of the cam plate in the finger bar drive module of FIGS. 4–6 responsive to motion of the crank arm illustrated in FIG. 8.

Continued clockwise rotation of shaft 70 and crank arm 80 (in the orientation of FIG. 8) an additional 90° brings crank arm 80 to the position 80*b* (FIG. 8) and roller follower 94 to the position 94*b* (FIGS. 8 and 9). During this second portion of crank arm rotation, cam plate 82 is lifted vertically toward its fully raised position 82*b* (FIG. 9), while roller follower 94 moves to the left in cam plate slot 92. The workpieces engaged by the fingers are lifted above the die station surfaces during this motion. In such lifted position, and with all crank arms 80 maintained at the position 80*b* illustrated in FIG. 8, longitudinal drive 36 (FIGS. 1 and 3) is activated to index the workpieces in the forward direction. Crank arm 80 is then rotated clockwise in the orientation of FIG. 8 from position 80*b* to position 80*a*, lowering cam plate 82 from position 82*b* to position 82*a*, and thereby lowering the indexed workpieces back onto the die station surfaces. Continued clockwise rotation of crank arm 80 in FIG. 8 retracts cam plate 82 from position 82*a*to position 82 in FIG. 9. At this point, drive 36 may be activated in the reverse direction to return the finger bars and figures to their initial positions illustrated in solid lines in FIGS. 1, 5–6 and 8–9. Disposition of crank arms 80 on both sides of support 66 helps balance the load on stub shaft 70.

Figure 7:
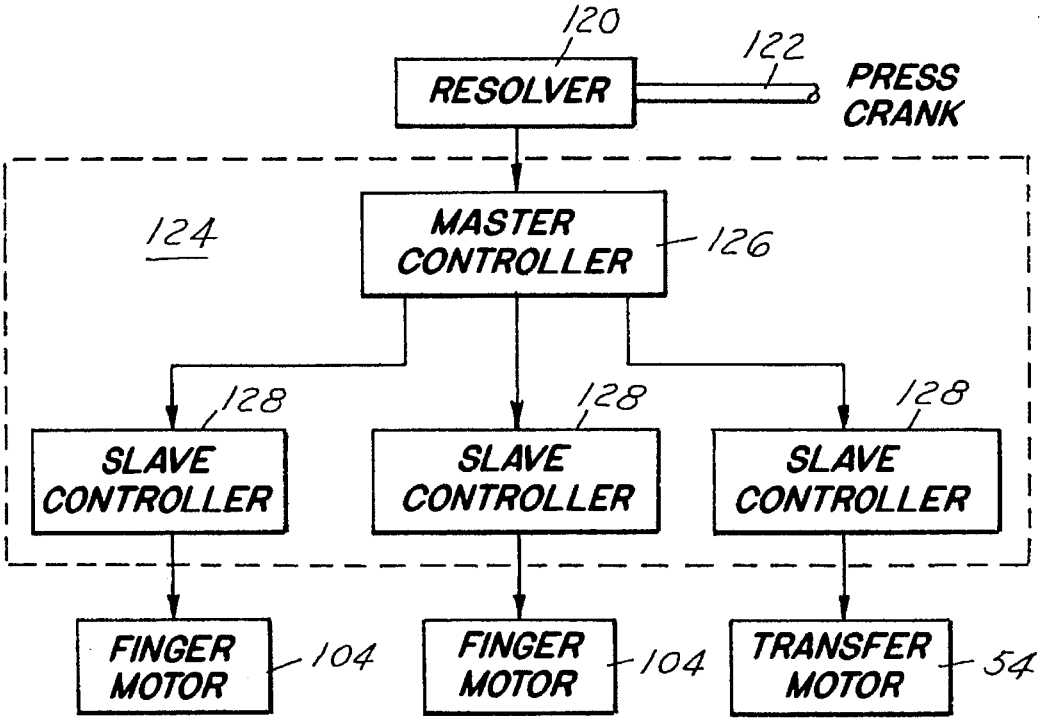
FIG. 7 is a functional block diagram of the transfer system drive electronics.
Figure 13B:
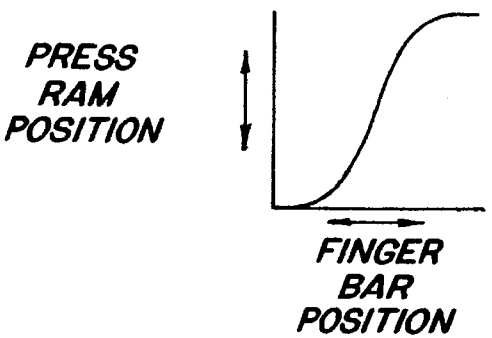
FIGS. 13A and 13B are graphs that illustrate control of finger bar position as a function of press ram position.
Figure 13A:
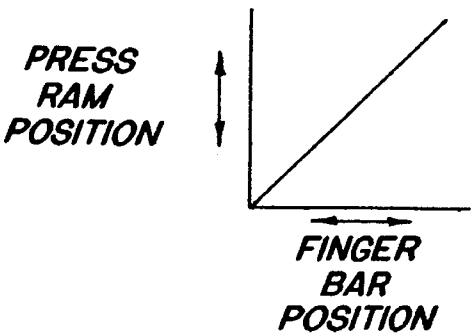

The drive electronics are illustrated functionally in FIG. 7. A resolver or other suitable position sensor 120 is coupled by a shaft 122 to the crank of press 30 (FIG. 2), and provides an electrical output signal indicative of press position to a motor control electronics package 124. Within electronics package 124, a master controller 126 receives the electrical signal from sensor 120 indicative of press position, and provides suitable control signals to slave controllers 128 individually coupled to the respective motors 104,104 and 54 (FIGS. 1 and 7). Thus, controller 124 controls motion of the finger bars and fingers through servo motors 104,54, as described above, as a function of press position. FIGS. 13A and 13B illustrate exemplary control techniques. During the portion of press operation in which the fingers are moved inward and outward, for example, FIG. 13A illustrates that finger position may be controlled as a linear function of ram position. On the other hand, in situations where it is desirable to provide for controlled acceleration and deceleration of the fingers, the press position versus finger bar position transfer function may be decidedly non-linear, as illustrated in FIG. 13B.

The desired transfer function is stored in electronic memory within master controller 126, preferably in the form of a look-up table. Thus, for any given press position provided as an input by sensor 120, master controller 126 generates appropriate output control information for each of the three axes of finger motion, which in turn control the servo motors 54,104 through slave controllers 128. The control information so stored in memory may be readily modified, or multiple look-up tables may be stored and selected by an operator or external controller. It will also be recognized that, in appropriate circumstances, the die transfer system of the present invention may employ less than the entire available range of motion for the finger bars and fingers, by employing less than the full 180° of crank rotation illustrated in FIG. 8. Thus, excess time and motion may be saved. It will thus be appreciated that the electronic and servo motor control provided in accordance with the disclosed embodiments of the invention is much more versatile than mechanical control arrangement typical of the prior art in which adjustment or modification of components is required to alter the finger control function.

Figure 11:
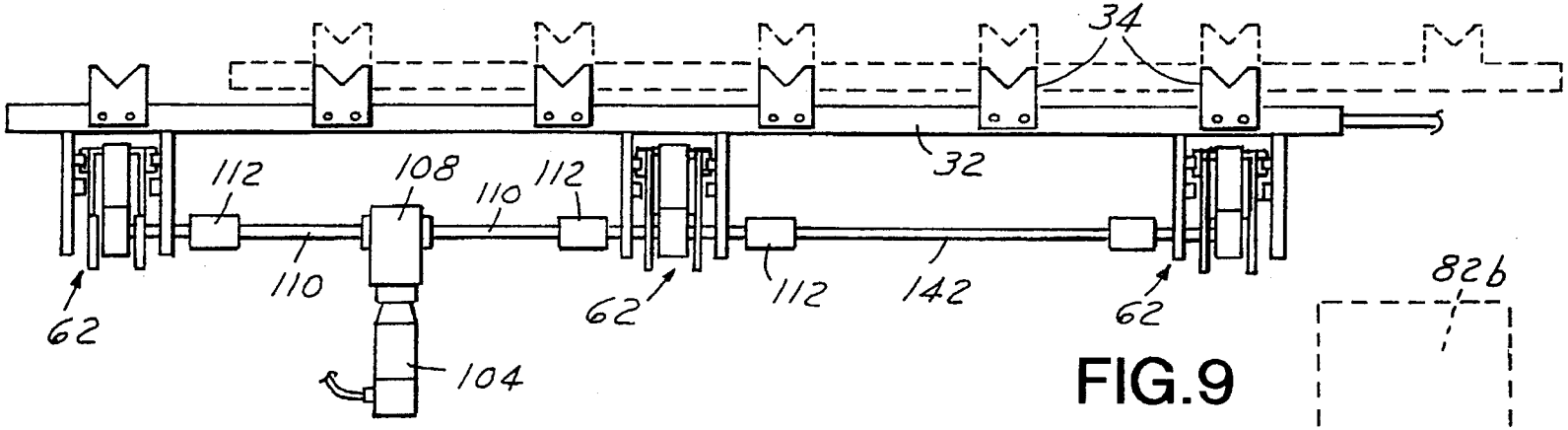
FIG. 11 is a fragmentary plan view of a die transfer system in accordance with another modified embodiment of the invention.
Figure 10:
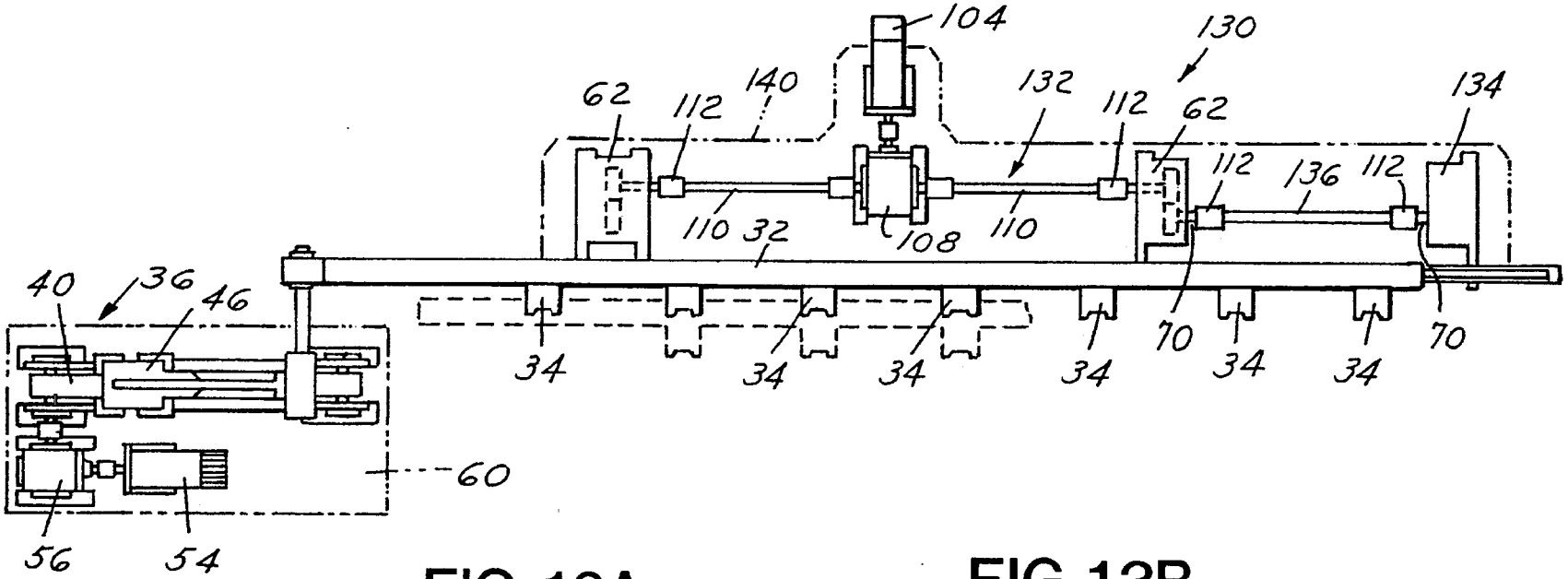
FIG. 10 is a plan view of a die transfer system in accordance with a modified embodiment of the invention.

FIG. 10 illustrates a modified die transfer system 130 in which the lateral drive mechanism 132 is effectively extended by means of an additional finger drive module 134 and a supplemental drive shaft 136. Shaft 136 is connected by couplers 112 to the ends of stub shaft 70 in the adjacent finger bar drive modules 62,134. Thus, drive shaft 36 is offset with respect to drive shaft segments 110. The entire lateral drive mechanism 132, including the additional finger drive bar module 134, is mounted on a base plate 140 for modular portability. In suitable applications, such as where the workpieces are inherently stable, a single lateral drive mechanism and finger bar may be employed, as shown in FIG. 10. FIG. 11 illustrates another modification to the basic embodiment of FIG. 1, in which finger bar 32 is again of extended length, and an additional finger bar drive module 62 is provided. In the embodiment of FIG. 11, the third finger bar drive module 62 is connected to the adjacent module 62 by a shaft segment 142, which is connected by couplers 112 in both drive modules to stub shaft 68 rather than stub shaft 70 as in FIG. 10. Both FIGS. 10 and 11 illustrate an important advantage of the modular drive construction of the present invention—i.e., that the drive arrangement can be extended in length merely by adding additional shaft segments and modules, but without major system redesign. A single system design may thus be employed in many applications by merely adding or deleting drive modules and shaft segments. The same component parts are employed, reducing inventory and assembly costs, and simplifying maintenance and repair.

Figures 12, 14:
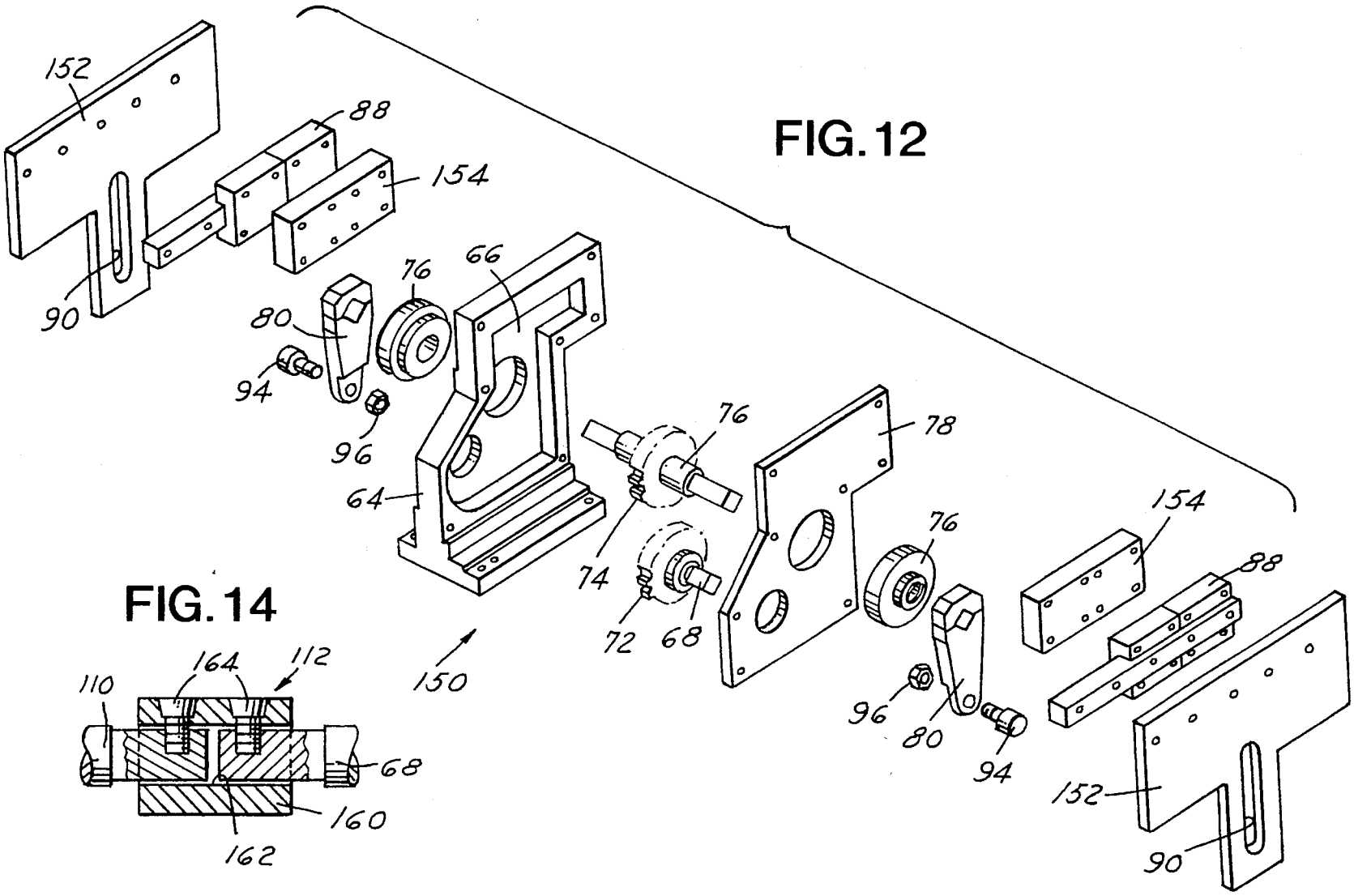
FIG. 12 is an exploded perspective view similar to that of FIG. 6 but illustrating a finger bar drive module in accordance with a modified embodiment of the invention.
FIG. 14 is a sectional view taken substantially along the line, 14—14 in FIG. 1.

FIG. 12 illustrates a modified finger bar drive module 150, which is basically identical to module 62 hereinabove described in detail, except that module 150 is adapted to drive the finger bar laterally inwardly and outwardly of the press stations, but not to lift the bar in the vertical direction. Thus, the cam plates 152 in FIG. 12 have only the vertical slot 90, and are connected to support 64 and cover plate 78 only by horizontal linear bearings 88 and spacer blocks 154. Thus, in this embodiment, rotation of crank arms 80 90° counterclockwise propels cam plates 52 inwardly toward the die stations, while reverse rotation 90° to the positions illustrated in FIG. 12 moves the finger bars outwardly from the die stations. Since no vertical movement is involved, stop cam 100 and stop cam roller 102 (FIGS. 4–6) have also be eliminated in drive module 150 in FIG. 12.

FIG. 14 illustrates coupler 112 as comprising a hollow collar 160 having an internal bore 162 that receives the squared ends of opposing shafts 110,68. A pair of set screws 164 extend diametrically through collar 160 into threaded openings in the opposing shaft ends. The tapered construction of the heads of screws 164, and the correspondingly tapered construction of the screw openings, both shown in FIG. 14, help firmly lock the screws in place.

We claim:

1. In a die transfer system for transferring workpieces between successive die stations in a stamping press, and including an elongated finger bar having spaced fingers for engaging workpieces at successive die stations, first means for reciprocating said finger bar longitudinally for transferring workpieces between successive die stations, and second means for reciprocating said finger bar laterally into and out of engagement with the workpieces at the die stations, the improvement wherein said second means comprises:

at least two finger bar drive modules coupled to said finger bar and spaced from each other lengthwise of said finger bar, drive shaft means extending between and interconnecting said drive modules, and means coupled to said drive shaft means for operating said drive shaft means and said finger bar drive modules in synchronism with operation of the stamping press, each of said finger bar drive modules comprising:

crank arm means, means operatively coupling said crank arm means to said drive shaft means for rotating said crank arm means about an axis parallel to said finger bar, cam plate means coupled to said finger bar and mounted for movement lateral to said axis and said finger bar, said cam plate means having cam slot means extending in a direction lateral to said axis, and cam follower means disposed in said slot means and coupled to said crank arm means such that rotation of said drive shaft means rotates said crank arm means and propels said cam follower means along said slot means while simultaneously driving said cam plate means and said finger bar laterally into and out of engagement with workpieces at the die stations, said drive shaft means comprising a plurality of shaft segments each extending between an adjacent pair of said modules, each of said modules including means for interconnecting successive drive shaft segments such that all of said drive shaft segments and all of said finger bar drive modules operate in unison, said means for interconnecting successive drive shaft segments comprising stub shaft ends rotatably carried by and projecting from said module, means within said module operatively interconnecting said stub shaft ends, and means for connecting said stub shaft ends to said successive drive shaft segments, said means operatively coupling said crank arm means to said drive shaft means comprising first gear means coupled to one of said stub shaft ends, and second gear means rotatably carried by said module and coupling said first gear means to said crank arm means.

2. The system set forth in claim 1 wherein said means interconnecting said stub shaft ends comprises a stub shaft integral with said ends and rotatably carried by said module, said first gear means being carried by said stub shaft.

3. The system set forth in claim 1 wherein said means interconnecting said stub shaft ends comprises said first and second gear means, said stub shaft ends, said coupler means and said successive drive shaft segments being laterally offset from each other.

4. The system set forth in claim 1 wherein each of said finger bar drive modules comprises support means having a pocket and cover plate means closing said pocket, said first and second gear means being disposed in said pocket.

5. The system set forth in claims 4 wherein each of said modules further comprises linear bearing means mounting said cam plate means to said support means.

6. The system set forth in claim 5 wherein at least one of said finger bar drive modules has first and second cam plate means disposed on opposed sides of said support means and respectively mounted to said support means by associated linear bearing means, first and second crank arm means on opposed sides of said support means, and first and second cam follower means on said first and second crank arm means and coupled to said first and second cam plate means respectively.

7. In a die transfer system for transferring workpieces between successive die stations in a stamping press, and including an elongated finger bar having spaced fingers for engaging workpieces at successive die stations, first means for reciprocating said finger bar longitudinally for transferring workpieces between successive die stations, and second means for reciprocating said finger bar laterally into and out of engagement with the workpieces at the die stations, the improvement wherein said second means comprises:

at least two finger bar drive modules coupled to said finger bar and spaced from each other lengthwise of said finger bar, drive shaft means extending between and interconnecting said drive modules, and means coupled to said drive shaft means for operating said drive shaft means and said finger bar drive modules in synchronism with operation of the stamping press, each of said finger bar drive modules comprising:

crank arm means, means operatively coupling said crank arm means to said drive shaft means for rotating said crank arm means about an axis parallel to said finger bar, cam plate means coupled to said finger bar and mounted for movement lateral to said axis and said finger bar, said cam plate means having cam slot means extending in a direction lateral to said axis, and cam follower means disposed in said slot means and coupled to said crank arm means such that rotation of said drive shaft means rotates said crank arm means and propels said cam follower means along said slot means while simultaneously driving said cam plate means and said finger bar laterally into and out of engagement with workpieces at the die stations, said cam plate means having first and second cam slot means extending in directions lateral to said axis and orthogonal and interconnected to each other, rotation of said drive shaft means and said crank arm means propelling said cam follower means along said first and second slot means in sequence and thereby driving said cam plate means and said finger bar sequentially in first and second directions at right angles to said axis and to each other.

8. The system set forth in claim 7 wherein said drive shaft means comprising a plurality of shaft segments each extending between an adjacent pair of said modules, each of said modules including means for interconnecting successive drive shaft segments such that all of said drive shaft segments and all of said finger bar drive modules operate in unions.

9. The system set forth in claim 8 wherein said means for interconnecting successive drive shaft segments comprises stub shaft ends rotatably carried by and projecting from said module, means within said module operatively interconnecting said stub ends, and means for connecting said shaft ends to said successive drive shaft segments.

10. The system set forth in claim 9 wherein said means operatively coupling said crankarm means to said drive shaft means comprises first gear means coupled to one of said stub shaft ends, and said gear means rotatably carried by said module and coupling said first gear mean to said crank arm means.

11. The system set forth in claim 7 wherein each said finger bar drive module includes support means and orthogonal liner bearing means mounting said cam plate means to said support means.

12. The system set forth in claim 7 wherein each said finger drive module further includes locking cam means operatively coupled to said drive shaft means for corotation with said crank arm means and locking cam follower means operatively coupled to said cam plate means, said locking cam means having means that engages said locking cam follower means during motion of said cam follower means along said second slot means to prevent said cam plate means and said finger bar from reverse motion in said first direction during motion in said second direction.

13. The system set forth in claim 12 wherein said locking cam follower means comprises a roller.

14. The system set forth in claim 7 wherein said cam follower means comprises a roller mounted for free rotation on said crank arm means.

15. The system set forth in claim 1 comprising a pair of elongated opposed finger bars on opposite lateral sides of said die stations, and a pair of said second means disposed or laterally opposed sides of said die stations and respectively coupled to said finger bars.

16. The system set forth in claim 15 further comprising a pair of portable base plates on which an associated finger bar and second means are mounted as a modular assembly.

17. The system set forth in claim 16 wherein said modular assemblies are mirror images of each other.

18. The system set forth in claim 12 wherein said means that engages said locking cam follower means comprises an arcuate cam surface on said locking cam means.

19. The system set forth in claim 18 wherein said crank arm means has an axis of rotation with which said arcuate cam surface is concentric.

20. In a die transfer system for transferring workpieces between successive die stations in a stamping press, and including an elongated finger bar having spaced fingers for engaging workpieces at successive die stations, first means for reciprocating said finger bar longitudinally for transferring workpieces between successive die stations, and second means for reciprocating said finger bar laterally into and out of engagement with the workpieces at the die stations, the improvement wherein said second means comprises:

at least two finger bar drive modules coupled to said finger bar and spaced from each other lengthwise of said finger bar, drive shaft means extending between and interconnecting said drive modules, and means coupled to said drive shaft means for operating said drive shaft means and said finger bar drive modules in synchronism with operation of the stamping press, each of said finger bar drive modules comprising:

crank arm means, means operatively coupling said crank arm means to said drive shaft means for rotating said crank arm means about an axis parallel to said finger bar, cam plate means coupled to said finger bar and mounted for movement lateral to said axis and said finger bar, said cam plate means having cam slot means extending in a direction lateral to said axis, and cam follower means disposed in said slot means and coupled to said crank arm means such that rotation of said drive shaft means rotates said crank arm means and propels said cam follower means along said slot means while simultaneously driving said cam plate means and said finger bar laterally into and out of engagement with workpieces at the die stations, said means for operating in synchronism with the stamping press comprising electric servo motor means coupled to said drive shaft means, means for monitoring operation of the stamping press and providing an electrical signal as a function thereof, and motor control means responsive to said electrical signal for operating said servo motor means.

21. The system set forth in claim 20 wherein said cam plate means has first and second cam slot means extending in directions lateral to said axis and orthogonal and interconnected to each other, rotation of said drive shaft means and said crank arm means propelling said cam follower means along said first and second slot means in sequence and thereby driving said cam plate means and said finger bar sequentially in first and second directions at right angles to said axis and to each other.

22. The system set forth in claim 20 wherein said means for monitoring press operation comprises means for providing said electrical signal as a function of press position, and wherein said motor control means includes means having prestored therein information coordinating desired finger bar position with press position, means for retrieving such information as a function of said signal, and means for controlling operation of said servo motor means as a function of such information so retrieved.

23. The system set forth in claim 20 further comprising a portable base plate on which said finger bar and said second means are mounted as a modular assembly.

24. The system set forth in claim 20 wherein said first means comprises an endless belt, means for reciprocating said belt in a direction parallel to said finger bar, and means coupling said belt to said finger bar.

25. In a die transfer system for transferring workpieces between successive die stations in a stamping press, and including an elongated finger bar having spaced fingers for engaging workpieces at successive die stations, first means for reciprocating said finger bar longitudinally for transferring workpieces between successive die stations, and second means for reciprocating said finger bar laterally into and out of engagement with the workpieces at the die stations, the improvement wherein said second means comprises:

at least two finger bar drive modules coupled to said finger bar and spaced from each other lengthwise of said finger bar, drive shaft means extending between and interconnecting said drive modules, and means coupled to said drive shaft means for operating said drive shaft means and said finger bar drive modules in synchronism with operation of the stamping press, each of said finger bar drive modules comprising:

crank arm means, means operatively coupling said crank arm means to said drive shaft means for rotating said crank arm means about an axis parallel to said finger bar, cam plate means coupled to said finger bar and mounted for movement lateral to said axis and said finger bar, said cam plate means having cam slot means extending in a direction lateral to said axis, and cam follower means disposed in said slot means and coupled to said crank arm means such that rotation of said drive shaft means rotates said crank arm means and propels said cam follower means along said slot means while simultaneously driving said cam plate means and said finger bar laterally into and out of engagement with workpieces at the die stations, said first means comprising an endless belt, means for reciprocating said endless belt in a direction parallel to said finger bar, and means coupling said endless belt to said finger bar.

26. The system set forth in claim 25 wherein said means for operating in synchronism with the stamping press comprises electric servo motor means coupled to said drive shaft means, means for monitoring operation of the stamping press and providing an electrical signal as a function thereof, and motor control means responsive to said electrical signal for operating said servo motor means.

27. The system set forth in claim 27 wherein said belt reciprocating means comprising electric servo motor means coupled to said belt, means for monitoring operation of the stamping press and providing an electrical signal as a function thereof, and a motor control means responsive to said electrical signal for operating said servo motor means.

28. The system set forth in claim 27 wherein said means for monitoring press operation comprises means for providing said electrical signal as a function of press position, and wherein said motor control means includes means having prestored therein information coordinating desired finger bar position with press position, means for retrieving such information as a function of said signal, and means for controlling operation of said servo motor means as a function of such information so retrieved.

29. The system set forth in claim 27 further comprising a portable base plate on which said first means is mounted as a modular assembly.

* * * * *